US006038996A

United States Patent [19]

Giles

[11] Patent Number: 6,038,996

[45] Date of Patent: Mar. 21, 2000

[54] MODULAR BOAT ANCHOR AND KIT

[76] Inventor: Richard Giles, 67 S. 300 East, Springville, Utah 84663

[21] Appl. No.: 09/198,739

[22] Filed: Nov. 24, 1998

[51] Int. Cl.[7] ..... B63B 21/24

[52] U.S. Cl. ..... 114/297; 114/301; 114/304

[58] Field of Search ..... 114/294, 297, 114/298, 301, 303, 304, 309, 310

[56] References Cited

U.S. PATENT DOCUMENTS

| | | | |
|---|---|---|---|
| 2,948,249 | 8/1960 | Gesner et al. | 114/208 |
| 3,280,783 | 10/1966 | Menning | 114/208 |
| 3,306,248 | 2/1967 | Austin | 114/208 |
| 3,404,652 | 10/1968 | Gardy | 114/297 |
| 3,759,212 | 9/1973 | Cluett | 114/208 |
| 3,766,877 | 10/1973 | Beck | 114/208 |
| 3,771,486 | 11/1973 | Hungerford | 114/208 |
| 3,780,688 | 12/1973 | Hungerford | 114/208 |
| 3,964,420 | 6/1976 | Stelling | 114/208 |
| 4,058,078 | 11/1977 | Stelling | 114/303 |
| 4,230,062 | 10/1980 | Fornasiero | 114/297 |
| 4,250,828 | 2/1981 | Cota | 114/307 |
| 4,397,256 | 8/1983 | Bruce | 114/303 |
| 4,655,158 | 4/1987 | Holder | 114/297 |
| 4,700,652 | 10/1987 | Pekny | 114/303 |
| 4,763,597 | 8/1988 | Stupakis | 114/297 |
| 4,892,053 | 1/1990 | Hallerberg | 114/303 |
| 4,958,586 | 9/1990 | Stupakis | 114/297 |
| 5,095,842 | 3/1992 | Soules | 114/297 |
| 5,154,133 | 10/1992 | Hallerberg | 114/303 |
| 5,353,732 | 10/1994 | Gramet et al. | 114/304 |

OTHER PUBLICATIONS

Pivot Point Pivot Point Catalog: Non–Threaded Fastener Solutions pp. 24–25 Aug. 1997.

E. Sullivan The Marine Encyclopaedia Dictionary pp. 22–25 1996.

Captain T. Lenfestey Dictionary of Nautical Terms pp. 13–405 1996 An Infobase Holdings Co.

Edited by B. W. Watson United States Navy A Dictionary pp. 61–63 1991 Garland Publishing, Inc.

Captain, U.S. Navy J. V. Noel, Jr. Captain, U.S. Navy E.L. Beach Naval Terms Dictionary, Fifth Edition pp. 12–15/ 208–209 1988 Naval Institute Press Annapolis, Maryland.

A. Ansted Dictionary of Sea Terms pp. 2–5 1985 Glasgow Brown, Son & Ferguson.

C.W.T. Layton Dictionary of Nautical Words and Terms pp. 14–15 1982 Brown, Son & Ferguson.

Captain USN, John V. Noel The VNR Dictionary of Ships & the Sea pp.8–11/254–255 1981 Van Nostrand Reinhold Co.

Joseph Palmer Jane's Dictionary of Naval Terms pp. 8–9 1975 MacDonald and Jane's.

Graham Blackbum The Illustrated Dictionary of Nautical Terms pp. 10–13/92–101 1981 David & Charles Newton Abbott London.

Gershom Bradford The Mariner's Dictionary pp. 6–9/196–197 1972 Barre Publishers Barre, Mass.

*Primary Examiner*—Stephen Avila
*Attorney, Agent, or Firm*—Workman Nydegger Seeley

[57] ABSTRACT

A modular anchor with a stress sensitive shank that permits its easy retrieval from the floor onto which the anchor became stuck. This retrieval is accomplished by merely pulling the anchor cable, the integrity of the cable being preserved as a consequence of the yielding of a shear pin that is part of the modular anchor. The shear pin breaks when it is subjected to a stress that satisfies a certain limit condition. The modular anchor may be disassembled to be carried in a bag with other elements useful for fastening a boat to shore. The anchor preferably has a fluke in the form of a plow or plowshare fluke.

34 Claims, 7 Drawing Sheets

MODULAR BOAT ANCHOR AND KIT

BACKGROUND OF THE INVENTION

1. The Field of the Invention

This invention relates to anchors that can be disassembled into modular components and stored and transported in a kit. More specifically, this invention relates to a modular anchor with an articulated arm that can pivot when the stress to which a releasing mechanism is subjected surpasses a critical break point.

2. Relevant Technology

An anchor is any device used to secure a floating body to the bottom of a body of water. An anchor cable is any line, wire, chain, etc., that runs from the floating body to the anchor. It is called an anchor cable, regardless of its configuration. The term "boat" will hereinafter refer to any floating body that is made fast by means of an anchor.

The parts of an anchor comprise a shank, arms terminating in flukes, a crown, and a stock. Although these parts are designated by well-known terms in the art, these parts are briefly characterized below for introducing basic terminology.

The shank is an elongated body with two ends. One of the shank's ends has an orifice or similar feature for attachment of the anchor cable, either directly or by means for linking an anchor cable with the shank end, such as a ring or a ring and a shackle. An anchor buoy may also be connected by a taut line to an anchor at this orifice. At its other end, the shank forms the crown. In some anchors, two arms attach to the shank at the crown.

The arms extend away from the crown and terminate in flukes, which are pointed structures for digging into the floor at the bottom of a body of water. The floor at the bottom of a body of water is hereinafter referred to as "floor". When the flukes dig into the floor and the anchor holds the ground well, it is said to bite. When the anchor bites, the fluke or flukes and the shank define an angle that is typically less than 90°.

Some anchors do not have arms, and the flukes are attached directly or very close to the crown or to the corresponding end of the shank. Typically, anchors with arms have a generally longitudinal stock at the end of the shank opposite to the crown. The stock is usually perpendicular to the shank and it is contained in a plane that is perpendicular to the plane that contains the arms. In some anchors with no arms, the stock extends away form the crown, in about equal lengths to each side, and the flukes, usually twin flukes, are mounted one on each side of the crown. Other anchors have no stock. See A. Ansted, *A Dictionary of Sea Terms,* pages 3–4, (1985)(this book will hereinafter be referred to as "Dictionary of Sea Terms").

Anchors receive different names depending on their parts. For example, the Admiralty Pattern or Fisherman's Anchor has a stock at right angles to the arms which causes the anchor to lie so that one of the flukes will bite into the floor. It has been in use for about 2000 years, but it has been superseded for a number of applications by the Stockless Anchor. The arms of the Stockless Anchor hinge on the shank and usually have tripping palms which cause the flukes to bite into the ground when a pull is exerted on the anchor. The Danforth Anchor has a light stock at the crown extending beyond the flukes to ensure that both flukes lie flat and bite into the ground. The Plough, Ploughshare or CQR Anchor ("CQR" merely being a phonetic play on "secure") is nowadays usually carried by small boats. It is also used to anchor floating objects such as buoys and platforms. In this stockless anchor, the flukes, shaped like ploughshares, turn on the shank and dig into the ground when the boat pulls upon its anchor. Stockless anchors are generally referred to with the terms "patent anchors". The Mushroom Anchor is shaped as its name indicates and it is usually employed on mud or other soft floors. See *Dictionary of Sea Terms,* pages 4–5; C. W. T. Layton, *Dictionary of Nautical Words and Terms,* page 14 (1982); John V. Noel, Jr., and Edward L. Beach, *Naval Terms Dictionary,* page 208 (1988);Graham Blackburn, *The Illustrated Dictionary of Nautical Terms,* pages 92, 101 (1981); *Jane's Dictionary of Naval Terms,* compiled by Joseph Palmer, page 8 (1975), and for illustrations of different types of anchors, see Thompson Lenfestey, *Dictionary of Nautical Terms,* page 14 (1994). A solid anchor is one where the shank and flukes are forged together, while a portable anchor, hereinafter referred to as a "modular anchor" is capable of being taken to pieces. See Gershom Bradford, *The Mariner's Dictionary,* page 7 (1972) (this book will hereinafter be referred to as "Mariner's Dictionary"). Modem anchors of light weight and high tensile strength are popular for boats of small tonnage, especially yachts. See *Mariner's Dictionary,* page 8.

Pulling from an anchor's shank usually digs the fluke's tip into the floor, thus making the anchor bite. The anchor's bite prevents the boat from drifting away from a determined area in which the boat is to remain. When the boat is to be under way again, its anchor has to be retrieved from the floor. To weigh anchor is to get the anchor up in preparation for getting under way. This is done by first heaving short, which is performed by hauling upon the anchor cable until the boat is nearly over its anchor, a maneuver that should ordinarily bring the anchor apeak. This is the anchor's position when it stands on its crown. The anchor is subsequently lifted form the floor, at which point the anchor is aweigh, and ultimately awash or above the water surface. The boat has been under weigh from the moment its anchor is weighed. See *Dictionary of Sea Terms,* pages 3–4.

This entire maneuver of getting the boat under weigh can be accomplished provided that the anchor bites the floor without sticking the flukes under a heavy object that will prevent the fluke tips from generally pointing upwards. In other words, when the flukes get stuck or entangled, the anchor will not be apeak at the end of the process of heaving short and the anchor's retrieval will be difficult or impossible. Although reportedly infrequently, the impossibility of getting the anchor aweigh and its subsequent loss is reflected by the incorporation in insurance policies of an Anchor and Chain Clause. According to this marine insurance clause, the underwriter is typically free from expenses to recover lost anchors and chains lost while the boat is afloat. See Eric Sullivan, *The Marine Encyclopaedic Dictionary,* 5th ed., page 23, (1996), and John V. Noel, *The VNR Dictionary of Ships & The Sea,* page 9 (1981). These references referred to hereinabove are hereby incorporated by reference.

A number of patents have disclosed anchors of different types. Generally, most anchors' designs focus on the improvement of features that will enhance the anchor's holding ability. These features include flukes that can pivot over a limited angular range. Limited pivoting is usually accomplished by structural elements whose function is to prevent the flukes from widely pivoting. In other words, these structural elements actually confine the angle defined by the shank and the flukes to an angle that is significantly less than 90°. These include U.S. Pat. No. 5,154,133 to Hallerberg which discloses a twin-fluke anchor that can be assembled in two different configurations to vary the shank-fluke angle to optimize the anchor's holding power. The assembly allows for limited pivoting of the shank relative to the twin flukes. U.S. Pat. No. 4,058,078 to Stelling discloses a twin-fluke anchor in which the flukes are mounted on a cross-bar that is orthogonal to the anchor's shank. The shank is allowed limited pivoting about the cross-bar. U.S. Pat. No. 3,766,877 to Beck discloses a pivoted fluke anchor with shank, fluke, and stock that have surfaces that are substantially free of obstructions to the flow of bottom soil thereover. U.S. Pat. No. 3,759,212 to Cluett discloses an anchor comprising preferably a single, replaceable fluke, and a hinged shank. The hinged shank comprises two sections each secured to an opposite end of an elastically extensible shock cord. In this anchor, the shank is structured to reduce shock transmitted from a fixed anchorage to the anchor, rode, and deck mooring gear. Preferably, this anchor includes a single, replaceable fluke which is pinned at an angle to the shank during use, and which can be folded for storage. U.S. Pat. No. 3,306,248 to Austin discloses a twin-fluke anchor with a floating device to orient the tips of the flukes and a pin-based mechanism to adjust the maximum pivoting angle of the shank with respect to the anchor's stock. This angle can be adjusted for different earth conditions on the bottom of the river, lake or sea in which the boat is to be anchored.

Although considerable attention has been given to the improvement of the anchor's design for enhancing the anchor's bite to a variety of floor conditions, a considerable smaller number of references address the problem of retrieving an anchor that is stuck or wedged on the floor. This problem is addressed in U.S. Pat. No. 2,948,249 to Gesner et al. which discloses a collapsible single-fluke and shank anchor with a means for facilitating the anchor's release when it is engaged with the bottom of a body of water. To facilitate its release, the anchor's shank engages the fluke by means of a resilient holding clamp and a pivoting attachment with a cross-arm. This pivoting attachment permits the shank to pivot almost freely when it is dislodged from the holding clamp, thus facilitating the retrieval of the entire anchor.

The engagement of an anchor's shank with a resilient holding clamp in the fluke is a release mechanism whose actuation will be increasingly less predictable and reproducible as the number of actuations increases. By repeatedly removing the shank from the holding clamp and reinserting it into the holding clamp, the clamp's resilience will diminish and it will also wear out by friction. Consequently, the holding ability of the shank and holding clamp assembly will gradually become less predictable and reproducible. In addition, rust removal and general maintenance operations is most likely to lead to additional wear of the holding clamp and shank system. Whereas replacement of worn out or non-conforming parts is a solution that often restores standard working conditions to an otherwise poorly performing mechanism, replacement is difficult when the holding clamp is built into the fluke, for its replacement would imply the disposal of the anchor or at least of its fluke, or the involvement of significant specialized work for removing and reattaching the worn out parts.

Conventional anchors do not have simple, reproducible and predictable features that would allow for the easy retrieval of the anchor when it is stuck in the floor. Recovery of these anchors becomes difficult or impossible. It is therefore desirable to provide an anchor with built in features that are simple, whose behavior is reproducible and predictable, and that facilitate the easy retrieval of the anchor when it would otherwise have to be abandoned on the floor after considerable time spent in attempting to free and recover it.

Each one of the afore-mentioned patents is hereby incorporated by reference in its entirety for the material disclosed therein.

SUMMARY AND OBJECTS OF THE INVENTION

An anchor that has become irretrievable usually wastes significant time while attempting to recover it. In addition, a lost anchor is a material loss, and it may prevent a boat from further sailing if no anchor replacement is available when in fact an anchor is needed.

Attempts to retrieve an anchor can be very time consuming, particularly when the boat is not equipped with retrieval means that are sufficiently powerful. Sometimes a dive is required to release an anchor that is stuck under objects that would render it irretrievable. When the mechanical retrieval means are powerful enough, attempting to retrieve an anchor that is stuck on the floor may lead to the rupture of the anchor cable and the loss of the anchor. Carrying spare anchors on board is not a convenient practice, but sailing with no anchor may simply be unacceptable and it could lead to an unexpected termination of a sailing trip or to a considerable loss of time while attempting to acquire a replacement anchor.

It is therefore desirable to provide an anchor that can easily be retrieved without significant material loss when it gets stuck in the floor. This anchor should be made of materials of which conventional anchors are ordinarily made, and it should incorporate components that are easy to install, replace and manufacture. This anchor should meet in particular the needs of small to medium sized boats with their inherent limitations in storage space.

The general object of this invention is to provide an anchor that can easily be retrieved from the floor when it is stuck thereon. More specifically, it is an object of this invention to provide an anchor that can be retrieved from the floor by simply pulling on the anchor cable without loosing the anchor and without causing the anchor cable to break upon the applied strain.

It is another object of this invention to provide an anchor that is modular, that can be easily assembled, and whose disassembled parts can be compactly stored.

It is another object of this invention to provide a modular anchor that can be part of a kit comprising the anchor assembly elements and other means for preventing the drifting of the boat.

It is another object of this invention to provide a modular anchor that can easily be retrieved from the floor when it is stuck therein and whose features can be incorporated into a plurality of existing types of anchor. In particular, it is an object of this invention to provide a modular plow anchor that can be easily retrieved from the floor when it is stuck thereon.

These and other objects of this invention are achieved by a modular anchor and a kit, the modular anchor comprising a shank, one of whose ends is pivotally engaged to a mount on a fluke. This mount is attached to the fluke or more specifically to the anchor's crown. Pivoting of the shank with respect to the fluke is allowed by the breaking of an element, such as a shear pin, upon subjecting it to a predetermined stress. When the shank and the mount pivot with respect to each other, the angle defined by the fluke and the shank can fully open to 180° if necessary. This pivoting permits the extraction of the anchor from under objects or other elements with which the anchor became stuck.

The substitution or replacement of the element in this invention that breaks prior to the pivoting of the shank with respect to the fluke is easy and it can be performed at will. Consequently, the predictability and reproducibility of the mechanical properties of this device can be maintained as part of the anchor's performance standards. These properties characterize the conditions under which the shank will be allowed to widely pivot with respect to the fluke.

The widening of the space between the shank and the fluke by pivoting advantageously renders the anchor in the present invention in a configuration that permits its extraction when the anchor's fluke is stuck under some heavy object on the floor.

The breakable element in this invention is chosen according to the predetermined stress level that will cause its rupture. The replaceable character of this element and its predetermined characteristic yield point are other advantages of this invention.

A further advantage of this invention is that the conditions that determine the wide pivoting of the shank with respect to the fluke are not susceptible to significant variation as a consequence of rust formation, wear caused by multiple actuation, or maintenance service. This is because the breakable element can be removed, reinserted, and replaced at will. In particular, this element can be removed for cleaning and maintenance purposes and it can be periodically replaced after a predetermined characteristic time period of use. The advantageous disposable character of this breakable element supplements and enhances other advantages of this invention. Furthermore, it is easy to carry a spare set of such breakable elements of different break point characteristics.

The modular character of this invention is another advantage that renders it especially suited for boats with limited storage space. This advantage is further enhanced by the portability of an anchor that embodies this invention, which can be transported from one boat to another boat. The modular character also allows for the replacement of individual parts without having to purchase another full anchor.

Another advantage of the present invention is that its constituent parts can be manufactured with the same materials that are used in the construction of conventional anchors. Consequently, any embodiment of the present invention can be made with materials of desired strength, durability, and density without having to resort to specialized technologies.

Additional objects and advantages of the invention will be set forth in the description which follows, and in part will be obvious from the description, or maybe learned by the practice of the invention. The objects and advantages of the invention maybe realized and obtained by means of the instruments and combinations particularly pointed out in the appended claims.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The present invention relates to modular boat anchors. More particularly, the present invention relates to a modular boat anchor with an articulated shank that can be pivoted by pulling from the shank while applying a strain that is greater than the limit condition determined by a predetermined stress range. When this limit condition is satisfied, the break point of one of the anchor's elements is reached and the shank can widely pivot with respect to the fluke. In addition, the present invention also relates to a kit for carrying the disassembled modular anchor. The exemplary embodiments shown in FIGS. 1–6 illustrate features of the present invention that will be discussed hereinbelow.

Figure 5:
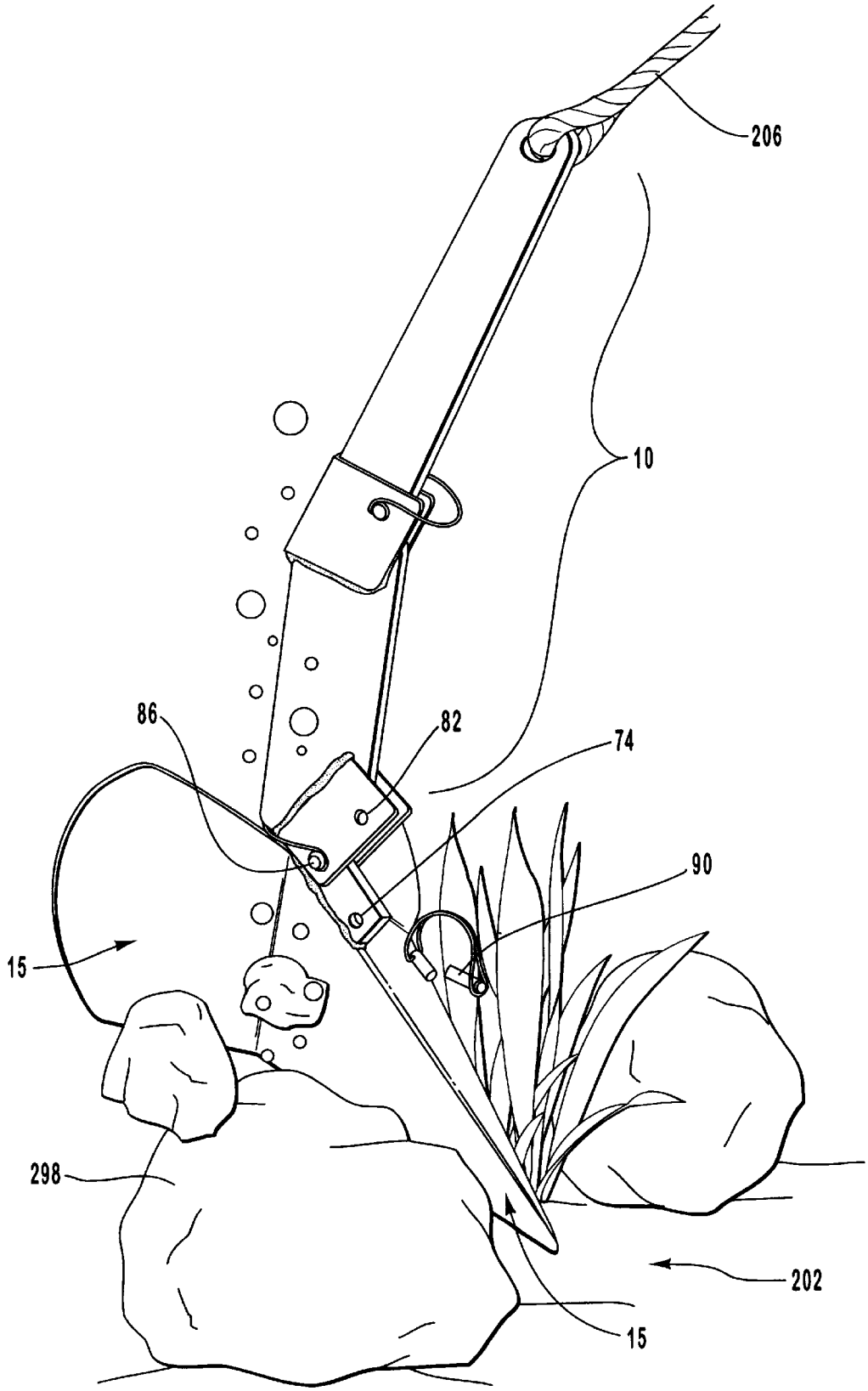
FIG. 5 is a schematic representation of the extraction of a modular anchor stuck at the bottom of a body of water.

The primary components include a shank 10, a fluke 15 that is detachably coupled to one end of the shank by a pivoting pin 86 and a shear pin 90 for allowing the shank to widely pivot with respect to the fluke. This pivoting takes place when a pull applied to the anchor's shank results in a certain strain applied to shear pin 90 which causes pin 90 to break as shown in FIG. 5.

Figure 1:
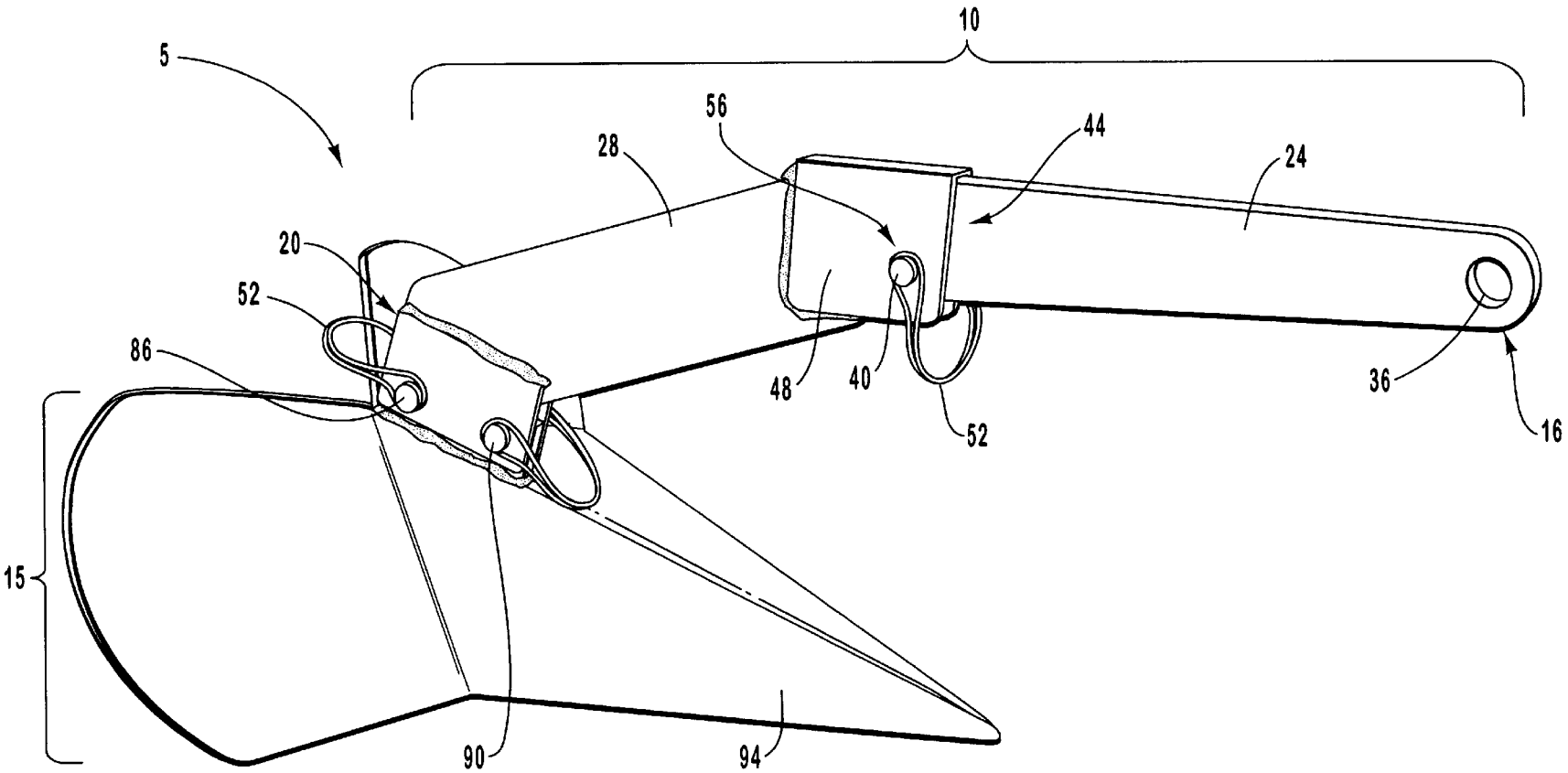
FIG. 1 is a perspective of a modular anchor with a ploughshare fluke in accordance with the present invention.

As shown in FIG. 1, an exemplary embodiment of the present invention comprises shank 10 detachably coupled to fluke 15. Fluke 15 as shown in the accompanying Figures is a preferred embodiment of a fluke, however, the fluke may be any other fluke known in the art and that is described in material that has been incorporated hereinabove by reference. These flukes include twin flukes, the Danforth anchor's flukes, and the flukes of a stockless anchor in which the arms hinge on the shank and usually have tripping palms that cause the flukes to bite into the ground when a pull is exerted on the anchor. Fluke 15 and the other flukes disclosed herein are examples of fluke means for preventing a water craft from drifting away from a determined area.

Although in most anchors, shank 10 is a single integral piece extending from link end 16 to pivot end 20, a preferred shank for an embodiment of the present invention comprises a plurality of components, in particular, attachment stem 24 and coupling arm 28 that are detachably connected to each other by pin 40 at coupling end 44 of attachment stem 24 and end 48 of coupling arm 28. The shank can also be a single integral piece with no welded components. The shanks disclosed herein are examples of shank means for connecting an anchor cable to a fluke means.

Link end 16 has an orifice, such as orifice 36 for attaching an anchor cable therethrough, either directly or by means for linking an anchor cable with link end 16 such as a ring or a ring and shackle combination. Link end 16 may have any suitable aperture and be used in conjunction with attachments or linking means known to anyone of ordinary skill in the art for linking an anchor cable to link end 16.

Pin 40 is preferably accompanied by a restraining device that is embodied in FIG. 1 by clip-type device 52. When used for restraining a pin, clip-type device 52 is preferably used with a pin that has a corresponding groove at one of the pin's ends and a perforation at the opposite end, as shown in FIG. 1, although it can also be used with a pin that has a corresponding groove at each one of its ends. Pin 40 is a preferred embodiment of a detachable coupling means for coupling attachment stem 24 with coupling arm 28. Detachable coupling means can be embodied by any device that can be inserted through matching apertures 56 at end 44 of attachment stem 24 and at end 48 of coupling arm 28, provided that its strength is such that it can withstand the strain derived from the pulling of shank 1 from link end 16 when the anchor bites or when an attempt to retrieve the anchor is made. This mechanical characteristic is known by a person of ordinary skill in the art for the materials that can be used for manufacturing pin 40 or an equivalent detachable coupling means. Other objects that can specifically embody this detachable coupling means include a shackle, a ring, a bolt, and a nut and bolt pair. Clip-type device 52 is an example of a restraining means for holding the pin within the apertures.

As shown in FIG. 1, end 48 is configured to receive end 44. In an equally preferred embodiment, end 44 can be configured to receive end 48. Furthermore, the receiving end can be integrally formed into or attached by welding to the shank. The perimeters of ends 44 and 48 are shown in FIG. 1 and accompanying figures as being generally rectangular. It is understood that other perimeters for either of these two ends could have any plurality of shapes, such as round, polygonal, or comprising a combination of arcuate and rectilinear portions.

Figure 2:
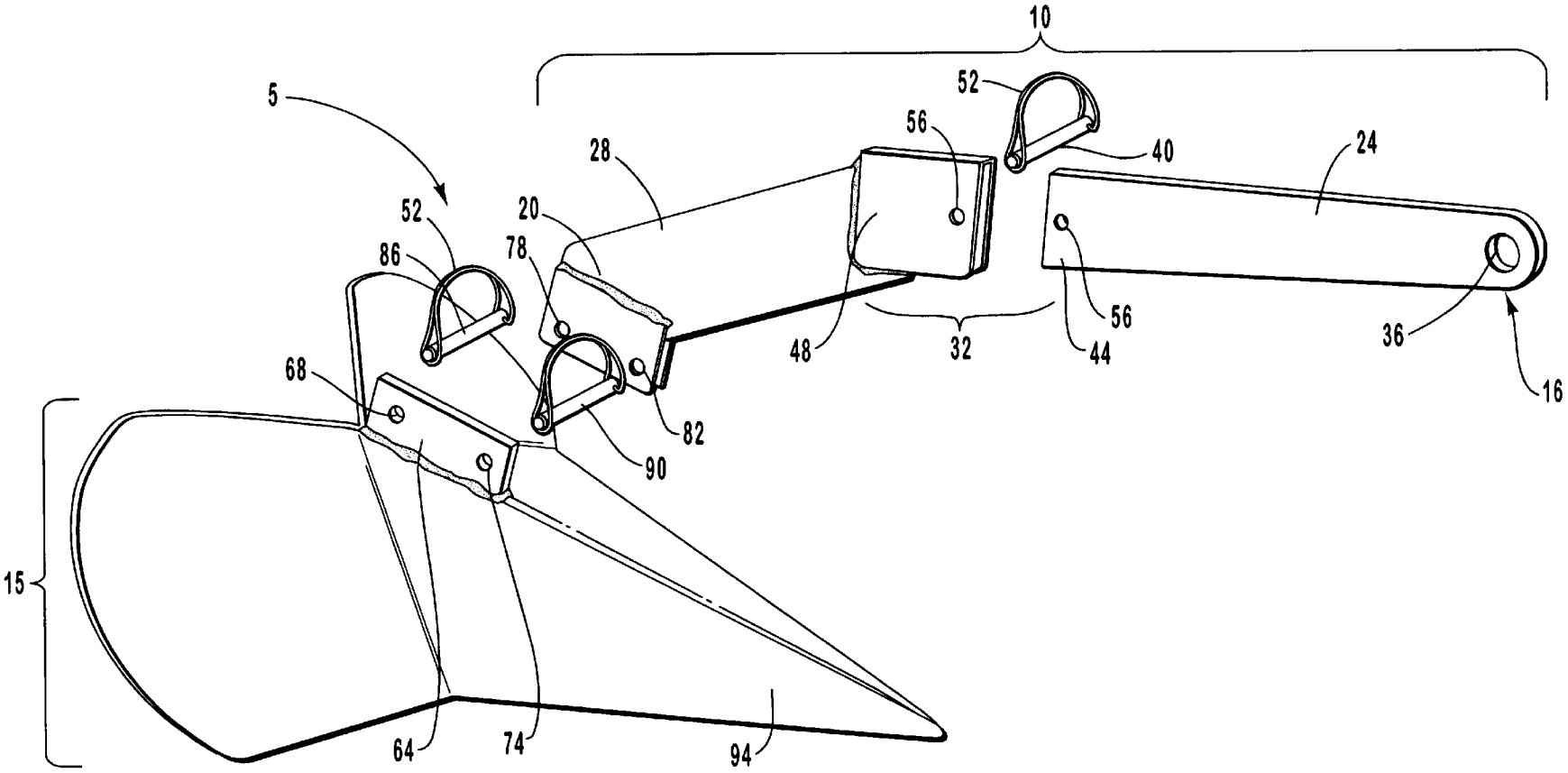
FIG. 2 is an exploded view of the embodiment shown in FIG. 1.

The elements described above are further illustrated in the exploded view shown in FIG. 2. Mount 64 in fluke 15 preferably has two apertures, hinge aperture 68 and break aperture 74. Pivot end 20 preferably has two apertures, pivot aperture 78 and shear aperture 82. As shown in FIG. 2, pivot end 20 is configured for detachably coupling with pivot end 20. In the specific embodiment shown in FIG. 2, mount 64 is received by pivot end 20. Analogously, pivot end 20 could be received by mount 64 by designing pivot end 20 as mount 64 is shown in FIG. 2 and by correspondingly designing mount 64 as pivot end is shown in FIG. 2. Furthermore, the perimeter of mount 64 and pivot end 20 are shown in FIG. 2 as being generally rectangular. It is understood that other perimeters for anyone of these two elements could have a plurality of shapes, such as round, polygonal, or comprising a combination of arcuate and rectilinear portions.

Pivot end 20 can be attached to shank 10 by welding or it may be integrally formed into shank 10. Analogously, mount 64 can be integrally formed into the fluke or it can be attached to the fluke by welding as shown. In the embodiments disclosed herein, the mount is part of the fluke. Accordingly, the fluke means includes a mount.

In a preferred embodiment of this invention, shank 10 is detachably coupled to fluke 15 with pivot pin 86 and shear pin 90. Pivot pin 86 is an embodiment of a pivot means for pivotally fastening shank 10 with fluke 15. Pivot pin 86 as shown in FIGS. 1 and 2 is a preferred embodiment of a pivot means. In addition to pivot pin 86, the pivot means can be embodied by a hinged device or by any device that can be inserted through hinge aperture 68 and pivot aperture 78 provided that its strength is such that it can withstand the strain derived from the pulling of shank 1 from link end 16 when the anchor bites or when an attempt to retrieve the anchor is made. This mechanical characteristic is known by a person of ordinary skill in the art for the materials that can be used for manufacturing this pivot means. More particularly, in addition to pivot pin 86, other objects that can specifically embody this pivot means include a shackle, a ring, a bolt, and a nut and bolt pair.

Shear pin 90 is an embodiment of a shear means for releasably engaging shank 10 with fluke 15. Embodiments of this shear means have a characteristic break point. When shear pin 90 breaks at its break point, shank 10 is allowed to pivot with respect to fluke 15 about pivot pin 86. Shear pin 90 is a preferred embodiment of a shear means that can also be embodied by an element that can be inserted through break aperture 74 and shear aperture 82 and has a characteristic break point. In particular, it can also be embodied by a shear ring, a shear shackle, a shear bolt, a shear bolt and nut, and a shear rivet.

Any embodiment of the shear means is chosen so that it has a certain break point which can be reached to break the shear means when the link end is pulled with the anchor undesirably immobilized at any region of the fluke. This break point has to be high enough so that it is not reached as a consequence of the normal strain applied to the shear means when the anchor bites while ordinarily holding a boat. However, this break point should not be so high that the anchor cable will break prior to the rupture of the shear means while attempting to retrieve an anchor that is stuck on the floor. According to this criterion, and with supplementary information such as known strengths of materials, and known stresses induced by pulls exerted by different forces, selecting the manufacturing materials for making the shear means of different characteristic break points should be a well-known process to a person of ordinary skill in the art.

Although shear pin 90 and pin 40 are preferably embodied by generally cylindrical pins, it is understood that any of these pins could also be embodied by a pin whose cross section is not generally circular provided that the apertures that receive the pin are correspondingly shaped.

Figure 3:
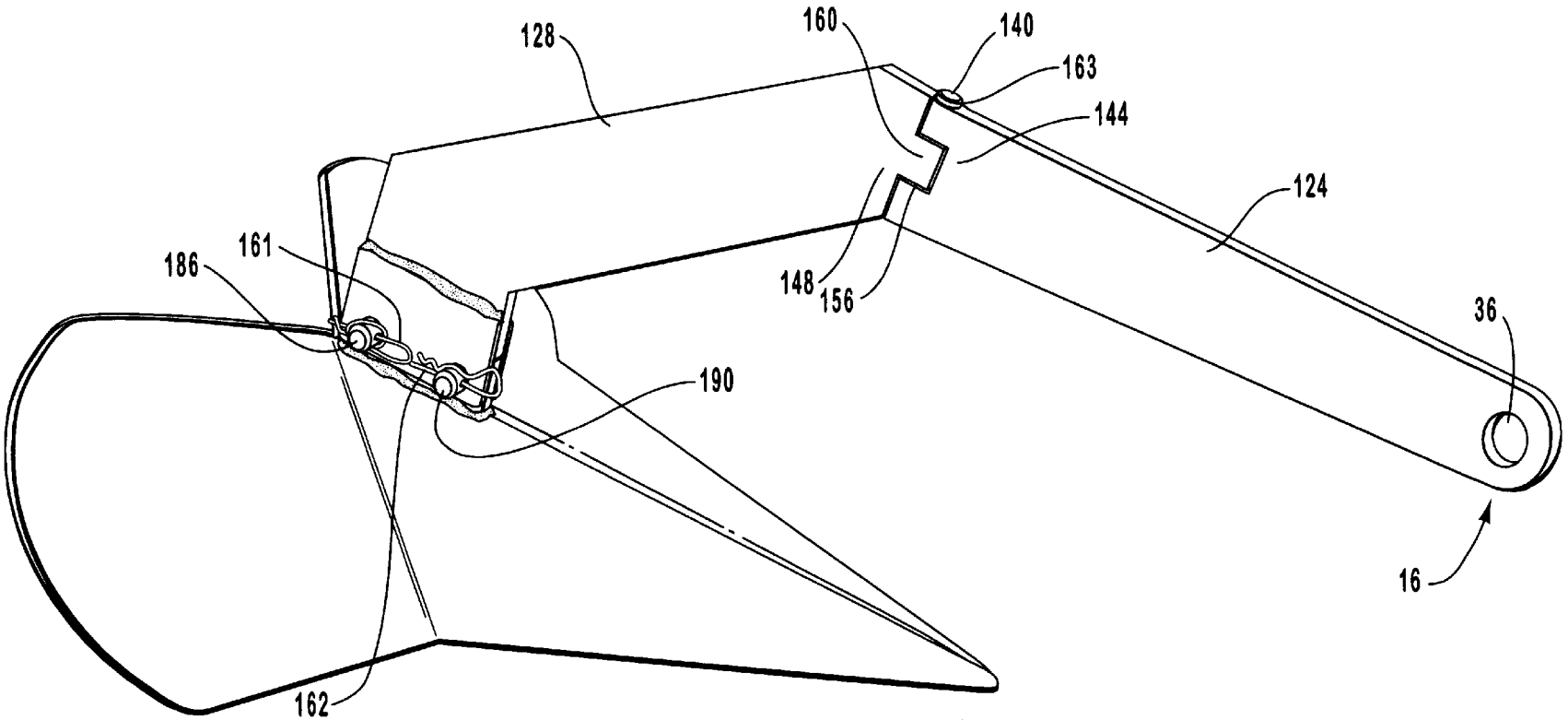
FIG. 3 is a perspective view of another embodiment of a modular anchor with a ploughshare fluke in accordance with the present invention.

FIG. 3 shows another embodiment of the present invention in which end 144 of attachment stem 124 and end 148 of coupling arm 128 are interlocking ends fastened by pin 140 through apertures 156. As shown in FIG. 3, protuberance 160 in end 148 is received by a recess in end 144. Symmetrically, protuberance 160 could be formed at end 144 that would then be received by a recess in end 148. Pin 140 may have a flanged head 163 as shown without any restraining means opposite the flanged head or pin 140 may also be configured for use with restraining means.

FIG. 3 shows other embodiments of a restraining means including a rue ring cotter pin 161 and a cotter pin 162. Rue ring cotter pin 161 or cotter pin 162 are preferably used with a perforated pin as shown in FIG. 3. In any of the pins used in embodiments of this invention, both ends of the pin may be perforated for accommodating restraining means such as cotter pin 162 or preferably a rue ring cotter pin 161. Additionally, one end of the pin may be perforated for use with a rue ring cotter pin 161 or a clip-type device 52 while the other end may be in the form of a flanged end (not shown). The flange in the flanged end is so dimensioned as to prevent its insertion through the aperture into which the pin is inserted like the flange head 163 of pin 140.

Figure 4:
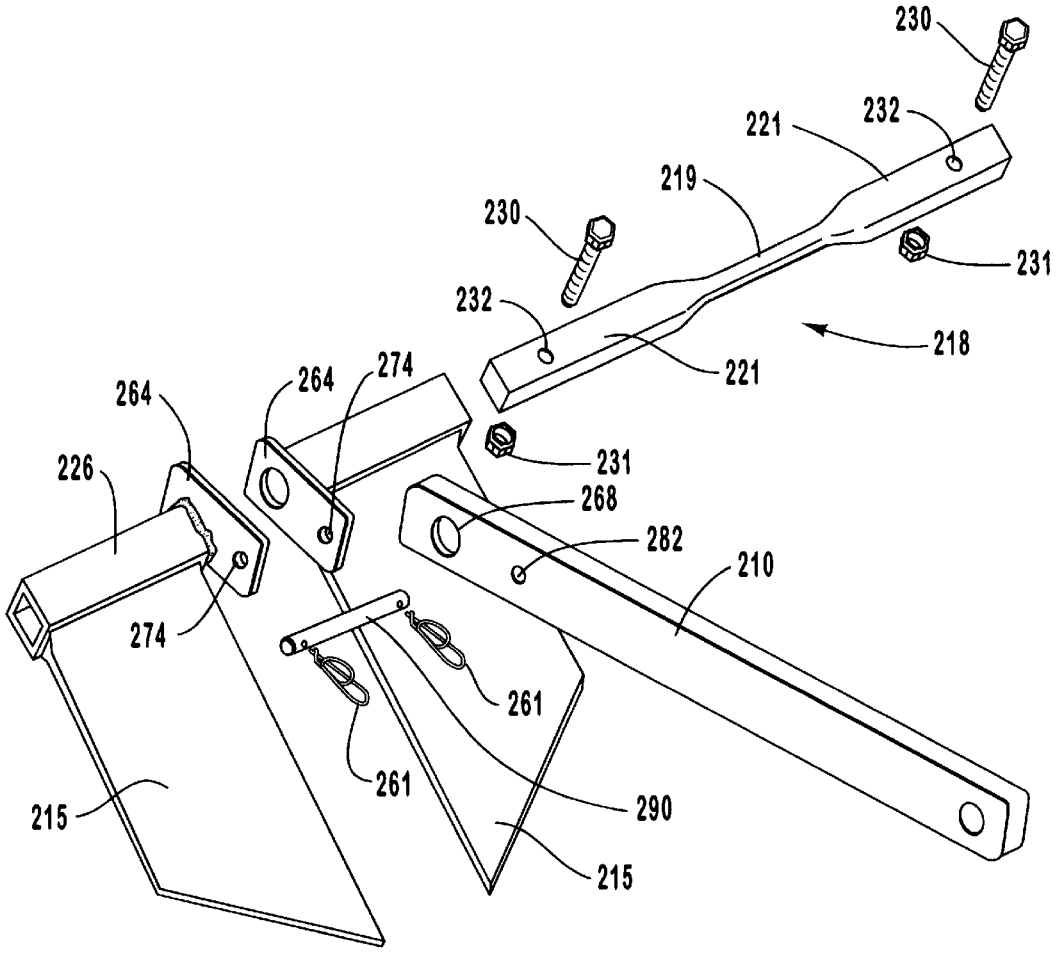
FIG. 4 is an exploded view of another embodiment of a modular anchor with twin flukes in accordance with the present invention.

FIG. 4 shows another embodiment of the present invention in which the fluke means is embodied by twin flukes 215. Shank 210 in the embodiment shown in FIG. 4 is an integral shank. The pivot means is embodied by stock 218. As shown in FIG. 4, stock 218 has a central portion 219 with a circular cross section and quadrilateral ends 221. Stock 218 is inserted through hinge aperture 268 in shank 210 that is configured to receive stock 218 therethrough. On each side of shank 210, stock 218 is received by each fluke 215 in a quadrilateral aperture or quadrilateral conduit 226.

In the embodiment shown in FIG. 4, each one of flukes 215 has a mount 264 that is configured for attachment with shank 210 and has a break aperture 274 that matches shear aperture 282 in shank 210. Mount 264 is preferably integrally attached to fluke 215, but it can also be embodied by a plate having a break aperture and another aperture for receiving stock 218 therethrough.

As shown in FIG. 4, the shear means is embodied by shear pin 290. The shear pin can have one flanged end and one perforated end or two perforated ends for a restraining device that is embodied in FIG. 4 by rue ring cotter pin 261.

Restraining means for preventing fluke 215 from sliding away from shank 210 is shown in FIG. 4 as bolt 230 and nut 231. Bolt 230 is received through orifice 232 in stock 218. This restraining means can also be embodied by a clamp or by any element that can be securely inserted through orifice 232, such as a ring, a shackle and a pin.

FIG. 5 shows how an embodiment of the present invention is retrieved after getting stuck in heavy objects 298 on floor 202. The pull applied through anchor cable 206 causes shear pin 90 to reach its characteristic break point, thus breaking lose from its engaging position through break aperture 74 and shear aperture 82. The subsequent pivoting of shank 10 with respect to fluke 15 about pivot pin 86 allows for the effective disengagement of fluke 15 from heavy objects 298 that would have otherwise prevented the easy retrieval of the anchor by merely pulling anchor cable 206.

Figure 6:
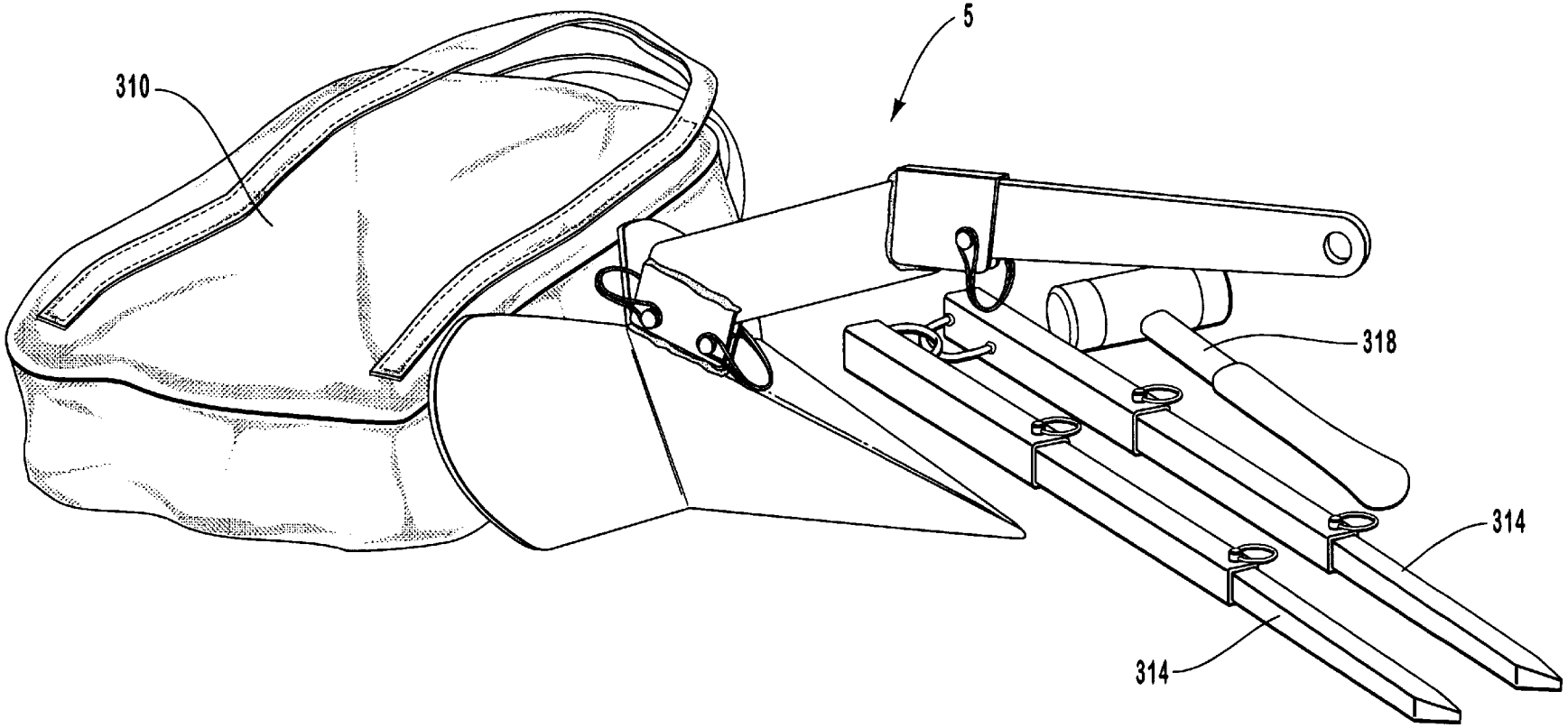
FIG. 6 is a perspective view of a modular anchor and other elements in the kit in accordance with the present invention.

FIG. 6 shows a kit according to the present invention. In addition to a modular anchor 5 according to the present invention, this kit comprises bag 310, stakes 314 and hammer 318. Telescopic stake 314 is a preferred embodiment of stake means for fastening a line from a boat to a watershore. Bag 310 shown in FIG. 6 is a preferred embodiment of a carrying means for receiving the anchor's modular components after disassembly. This carrying means can also be embodied by a carrier that internally or externally receives the modular components of an anchor and any additional embodiments of stake means and hammer 318.

Figure 7:
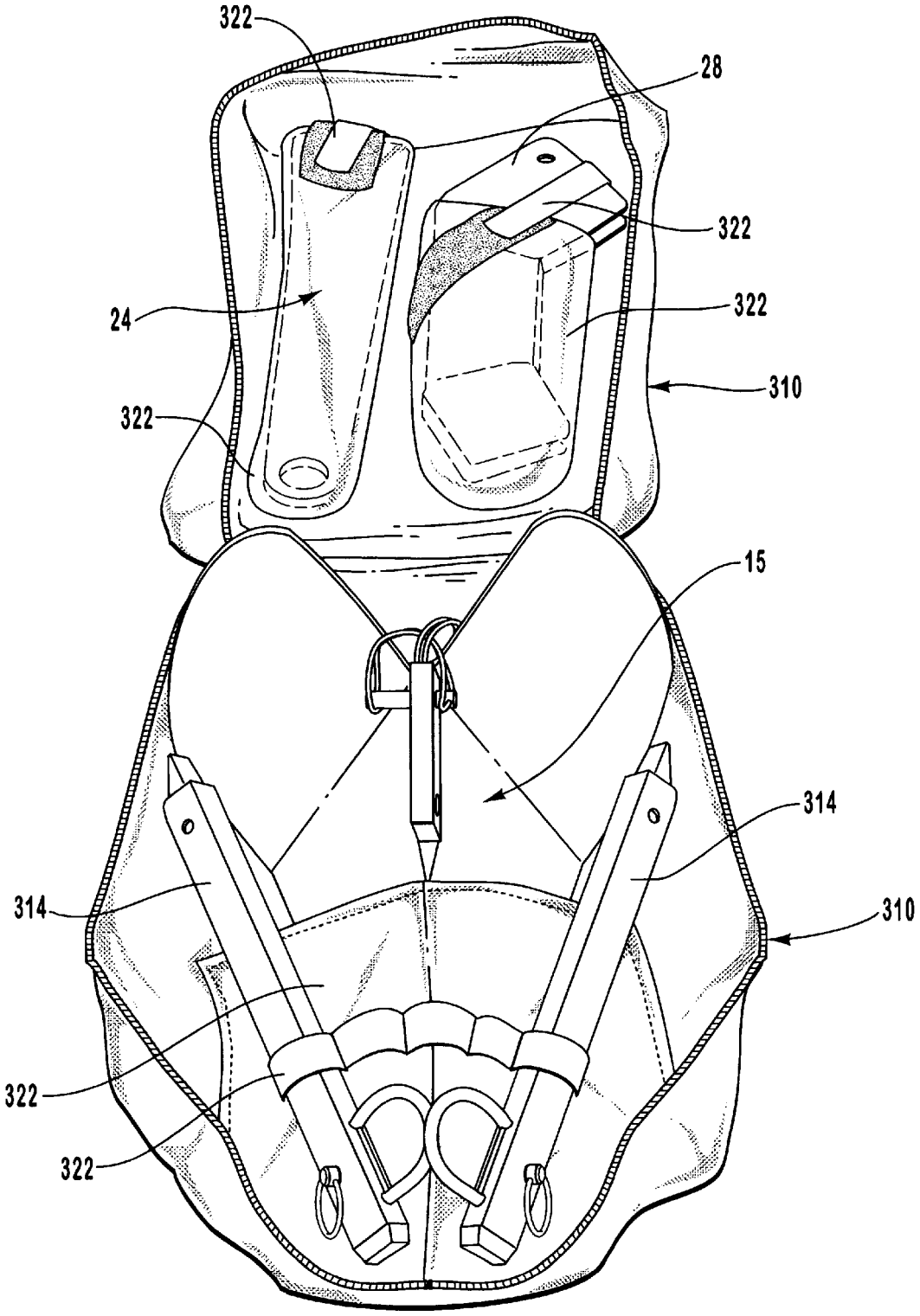
FIG. 7 is a perspective view of a disassembled modular anchor and other elements stowed in a carrying bag in accordance with the present invention.

FIG. 7 shows an embodiment of a kit according to the present invention with bag 310 internally receiving the modular components of a modular anchor and any additional embodiments such as those of the stake means. Preferably, bag 310 or any of its equivalent embodiments contains retaining means for keeping the anchor's modular components and any additional embodiments such as those of stake means. These retaining means can be embodied by retainers 322 shown in FIG. 7, and more specifically by pouches, straps, loops, pockets and combinations thereof.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by united states Letters Patent is:

1. A modular boat anchor, comprising:

a shank with a link end and a pivot end, said pivot end having two apertures, a pivot aperture and a shear aperture;

fluke means for preventing a water craft from drifting away from a determined area, said fluke means having a mount, said fluke means having two apertures including a hinge aperture and a break aperture, said mount being configured for detachably coupling with said pivot end of said shank;

pivot means for pivotally fastening said shank with said fluke means at said pivot aperture of said shank and at said hinge aperture of said fluke means; and shear means for releasably engaging said shank with said fluke means at said shear aperture of said shank and at said break aperture of said fluke means, wherein said shear means is capable of breaking at a characteristic yield point upon being subjected to stress, thereby enabling said fluke means to pivot away from said shank.

2. A modular boat anchor as recited in claim 1, wherein said shank comprises an attachment stem and a coupling arm, said attachment stem being connected to said coupling arm by a detachable coupling means.

3. A modular boat anchor as recited in claim 2, wherein said detachable coupling means is selected from the group consisting of a pin, a shackle, a ring, a bolt, and a nut and bolt pair.

4. A modular boat anchor as recited in claim 1, wherein said mount is configured to receive said pivot end of said shank.

5. A modular boat anchor as recited in claim 1, wherein said pivot end of said shank is configured to receive said mount.

6. A modular boat anchor as recited in claim 1, wherein said fluke means comprise a plough-shape fluke.

7. A modular boat anchor as recited in claim 1, wherein said fluke means comprise a first fluke unit on one side of said mount and a second fluke unit on another side of said mount.

8. A modular boat anchor as recited in claim 7, wherein said fluke means comprise pivoting fluke units.

9. A modular boat anchor as recited in claim 1, wherein said pivot is selected from the group consisting of a pin, a bolt, a bolt and a nut, a ring, and a shackle.

10. A modular boat anchor as recited in claim 1, wherein said shear means is selected from the group consisting of a shear pin, a shear ring, a shear shackle, a shear bolt, a shear bolt and a nut, and a shear rivet.

11. A modular boat anchor, comprising:

a shank with a link end and a pivot end, said pivot end having two apertures, a pivot aperture and a shear aperture;

a fluke having a mount, the mount having two apertures including a hinge aperture and a break aperture, said mount being configured for detachably coupling with said link end of said shank;

a fastener positioned in said pivot aperture of said shank and in said hinge aperture of said mount; and a breakable fastener positioned in said shear aperture of said shank and in said break aperture of said fluke, wherein said breakable fastener is capable of breaking at a pronounced yield point upon being subjected to stress, thereby enabling said fluke to pivot away from said shank at said fastener after breaking.

12. A modular boat anchor as recited in claim 11, wherein said shank comprises an attachment stem and a coupling arm, said attachment stem being connected to said coupling arm by a detachable coupling means.

13. A modular boat anchor as recited in claim 12, wherein said detachable coupling means is selected from the group consisting of a pin, a shackle, a ring, a bolt, and a nut and bolt pair.

14. A modular boat anchor as recited in claim 11, wherein said mount is configured to receive said pivot end of said shank.

15. A modular boat anchor as recited in claim 11, wherein said pivot end of said shank is configured to receive said mount.

16. A modular boat anchor as recited in claim 11, wherein said fluke is a ploughshare fluke.

17. A modular boat anchor as recited in claim 11, wherein said fluke comprises a first fluke unit on one side of said mount and a second fluke unit on another side of said mount.

18. A modular boat anchor as recited in claim 17, wherein said fluke comprises pivoting fluke units.

19. A modular boat anchor as recited in claim 11, wherein said fastener is selected from the group consisting of a pin, a bolt, a bolt and a nut, a ring, and a shackle.

20. A modular boat anchor as recited in claim 11, wherein said breakable fastener is selected from the group consisting of a shear pin, a shear ring, a shear shackle, a shear bolt, a shear bolt and a nut, and a shear rivet.

21. A modular boat anchor, comprising:

a shank having an attachment stem and a coupling arm, said attachment stem having a link end and a stem coupling end, said coupling arm having a pivot end and an arm coupling end, said stem coupling end having at least one stem aperture, said arm coupling end having at least one arm aperture, and said pivot end having two apertures, a pivot aperture and a shear aperture;

coupling means for coupling said attachment stem with said coupling arm at said stem aperture of said attachment stem and at said arm aperture of said coupling arm;

a fluke having a mount, the fluke having two apertures located in the mount including a hinge aperture and a break aperture, said mount being configured for detachably coupling with said link end of said shank;

a fastener positioned in said pivot aperture of said shank and in said hinge aperture of said mount; and a breakable fastener positioned in said shear aperture of said shank and in said break aperture of said mount, wherein said breakable fastener is capable of breaking at a pronounced yield point upon being subjected to stress, thereby enabling said fluke to pivot away from said shank at said fastener after breaking.

22. A modular boat anchor as recited in claim 21, wherein said coupling means is selected from the group consisting of a pin, a shackle, a ring, a bolt, and a nut and bolt pair.

23. A modular boat anchor as recited in claim 21, wherein said mount is configured to receive said pivot end of said shank.

24. A modular boat anchor as recited in claim 21, wherein said pivot end of said shank is configured to receive said mount.

25. A modular boat anchor as recited in claim 21, wherein said fluke is a ploughshare fluke.

26. A modular boat anchor as recited in claim 21, wherein said fluke comprises a first fluke unit on one side of said mount and a second fluke unit on another side of said mount.

27. A modular boat anchor as recited in claim 26, wherein said fluke comprises pivoting fluke units.

28. A modular boat anchor as recited in claim 21, wherein said fastener is selected from the group consisting of a pin, a bolt, a bolt and a nut, a ring, and a shackle.

29. A modular boat anchor as recited in claim 21, wherein said breakable fastener is selected from the group consisting of a shear pin, a shear ring, a shear shackle, a shear bolt, a shear bolt and a nut, and a shear rivet.

30. A kit for storing and transporting a boat anchor, comprising:

(a) a modular anchor having modular components including a shank with a link end and a pivot end, said pivot end having two apertures, a pivot aperture and a shear aperture, a fluke means for preventing a water craft from drifting away from a determined area, said fluke means having a mount, said fluke means having two apertures including a hinge aperture and a break aperture, said mount configured for detachably coupling with said link end of said shank, pivot means for pivotally fastening said shank with said fluke means at said pivot aperture of said shank and at said hinge aperture of said fluke means, shear means for releasably engaging said shank with said fluke means at said shear aperture of said shank and at said break aperture of said fluke means, wherein said shear means breaks at a pronounced yield point upon being subjected to stress, thereby enabling said fluke means to pivot away from said shank; and (b) carrying means for receiving said modular components of said modular anchor after said modular anchor is disassembled.

31. A kit for storing and transporting a boat anchor as recited in claim 30 further comprising:

stake means for fastening a line from a boat to a watershore.

32. A kit for storing and transporting a boat anchor as recited in claim 30, wherein said kit further comprises a telescopic stake.

33. A kit for storing and transporting a boat anchor as recited in claim 30, wherein said kit further comprises a hammer.

34. A kit for storing and transporting a boat anchor as recited in claim 30, wherein said carrying means has a plurality of retaining means for keeping said modular components in a location within the carrying means.

* * * * *